US005974831A

United States Patent [19]

Afuku et al.

[11] Patent Number: 5,974,831

[45] Date of Patent: Nov. 2, 1999

[54] JEWEL HOLDING DEVICE

[75] Inventors: Kazusane Afuku; Akira Koitabashi, both of Tokyo, Japan

[73] Assignee: Yama Co. Lt., Tokyo, Japan

[21] Appl. No.: 08/927,231

[22] Filed: Sep. 10, 1997

[51] Int. Cl.[6] ..... A44C 17/02

[52] U.S. Cl. ..... 63/26; 63/27; D11/91

[58] Field of Search ..... 63/26, 27, 29.1; D11/91, 92

[56] References Cited

U.S. PATENT DOCUMENTS

| | | | |
|---|---|---|---|
| 1,667,680 | 4/1928 | Sammartino | 63/26 X |
| 2,132,905 | 10/1938 | Maynier | 63/26 X |
| 2,733,579 | 2/1956 | Pfeffer et al. | 63/29.1 |
| 5,090,217 | 2/1992 | Beber et al. | 63/27 |
| 5,475,910 | 12/1995 | Yamamoto | 63/26 X |
| 5,680,776 | 10/1997 | Shenav | 63/26 |
| 5,755,117 | 5/1998 | Shenav | 63/26 |

FOREIGN PATENT DOCUMENTS

| | | | |
|---|---|---|---|
| 649216 | 11/1990 | Australia | 63/26 |
| 0 645 104 | 3/1995 | European Pat. Off. . | |
| 2707143 | 1/1995 | France | 63/26 |
| 71 32 975 | 5/1972 | Germany . | |
| 39 31 109 | 3/1991 | Germany . | |
| 5-37041 | 6/1993 | Japan . | |
| 6-8730 | 3/1994 | Japan . | |
| 260123 | 2/1949 | Switzerland | 63/26 |
| 893567 | 12/1981 | U.S.S.R. | 63/26 |
| 2 298 566 | 9/1996 | United Kingdom . | |

*Primary Examiner*—Brian K. Green
*Assistant Examiner*—Andrea Chop
*Attorney, Agent, or Firm*—Heslin & Rothenberg, P.C.

[57] ABSTRACT

The jewel holding device of the present invention comprises a claw section 4 for engaging with the crown 17 and the table 16 of a facet-cut jewel 14, an engaging section 11 for engaging with the pavilion 21, a support seat 9 for supporting the region near the culet 20, and a contact avoiding section 7 for avoiding contact with the girdle 22; and these elements are integrally formed. The contact avoiding section 7 is formed into an arc or arcuate shape and is capable of being elastically deformed when holding the jewel 14. Viewed from the direction looking into the table 16, the end 5 of the claw section 4 engaging with the table 16 is positioned at the outer side of the support seat 9 at the lower conical section of the jewel 14.

3 Claims, 4 Drawing Sheets

JEWEL HOLDING DEVICE

FIELD OF THE INVENTION

The present invention relates to a jewel holding device for holding a facet-cut jewel used in accessories such as rings, pendants, broaches, and clipped or pierced ear rings.

BACKGROUND OF THE INVENTION

In the past, most of the jewel holding devices held or fixed their jewel by clamping a plurality of fixing claws on each jewel.

On the other hand, as shown in FIG. 3, a jewel holding device 101, disclosed in the Patent Publication No. 5-37041, comprises a ring part 102 and a U-shaped metallic base 103 laterally fixed onto the ring part 102. The U-shaped metallic base 103 includes an upper leg part 104 and a lower leg part 105 longer than the upper leg part 104 and having a hole 107 with an indentation 106. A facet-cut jewel 114 is held by the jewel holding device 101 at three points: the upper leg part 104, the indentation 106 of the lower leg part 105, and a lateral part 108.

Further, as shown in FIGS. 4A and 4B, a jewel attachment structure, disclosed in the Utility Model Publication No. 6-8730, comprises a claw section 111 forming a concave surface 110 attached near a girdle 116 of a facet-cut jewel 114.

However, concerning the jewel holding devices with a plurality of fixing claws for clamping, much of the cut surfaces of a jewel is hidden by the plurality of fixing claws and these surfaces are consequently partially obstructed from view. The jewel holding device of FIG. 3 is formed by two separate parts, the U-shaped metallic base 103 and the ring part 102, and therefore, problems of manufacturing with two separate parts in relation to such things as strength of attachment between the two parts, positioning, and surface finishing become troublesome issues.

Further, the claws of the jewel attachment structure of FIGS. 4A and 4B do not reach to the table 117, and hence, to secure the jewel tightly the claws have to be widened significantly and cannot be made narrow.

The objects of the present invention are to provide an aesthetically pleasing jewel holding device that exposes adequately the cut surfaces of the jewel, that can be manufactured easily, and that securely holds the jewel.

SUMMARY OF THE INVENTION

To achieve the aforementioned objects, the jewel holding device of the present invention for holding on one side a facet-cut jewel, which includes a frusto-conical section having a crown and a table formed by cutting the top side of a conic section, the top side being in parallel with the bottom surface of the conic section, and a lower conical section that is approximately conical and located at the lower side, comprises a claw section that engages with the crown and the table, an engaging section that contacts a pavilion, which is the side surface of the lower conic section, a support seat for supporting the region around a culet, which is the head point of the lower conical section, and a contact avoiding section for avoiding contact with the girdle which is between the crown and the pavilion, wherein the claw section, the contracting section, and the support seat are integrally formed together with the contact avoiding section.

According to the jewel holding device of the present invention, the jewel can be securely held without the concern for detachment and the cut surfaces can be adequately exposed for view with the utilization of the claw section, the engaging section for engaging with the lower conical section, and the support seat. Since this jewel holding device is integrally formed, it is reliably strong, can be manufactured easily, and is aesthetically pleasing to look at. Further, since the contact avoiding section is provided for avoiding contact with the girdle which is between the frusto-conical section and the lower conical section of a jewel, the holding device can hold any jewel with different girdle thickness and different angle formed by the girdle and the crown. Since the girdle and the neighboring region do not contact the jewel holding device, the jewel can be securely held.

Moreover, the contact avoiding section is formed in a concave shape to have the capability of deforming elastically when the jewel holding device is holding the jewel. Since, elastic deformation also occur between the claw section and the support seat with the elastic deformation of the contact avoiding section, fixing or holding the jewel can be easily accomplished; and after holding or fixing the jewel, elastic force prevents the jewel from coming off.

In any of the devices of the present invention above, from the perspective of looking through the table, the end of the claw section for engaging with the table is positioned at the outer side of the support seat at the lower conical section of the jewel. This claw section, in addition to the effects as described above, allows the cut surfaces of the jewel to be adequately exposed to improve the aesthetics of the jewel.

DESCRIPTION OF THE PREFERRED EMBODIMENT

The present invention is related to a jewel holding device for holding or fixing facet-cut precious or semi-precious stones such as sapphires, rubies, and diamonds used in accessories, namely, rings, pendants, broaches, clipped or pierced ear rings, and so on. The preferred embodiments of the present invention will be explained below in conjunction with figures.

Figure 1A:
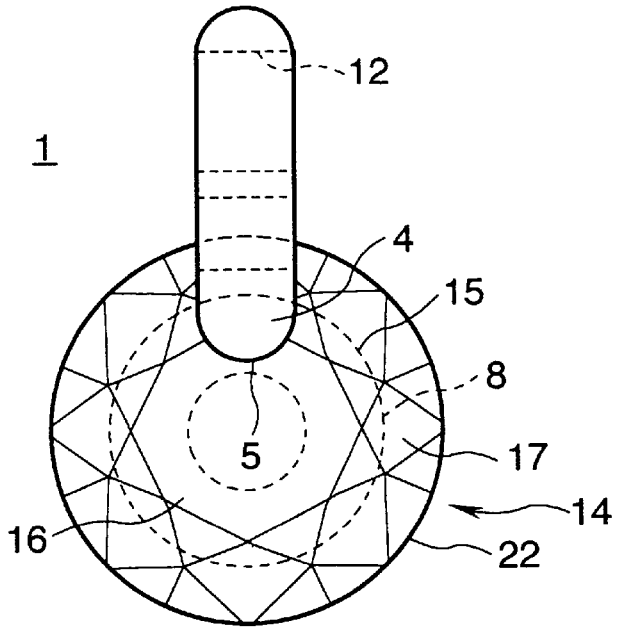
FIG. 1A shows a top surface view of a jewel holding device structure of the preferred embodiment of the present invention.
Figure 1B:
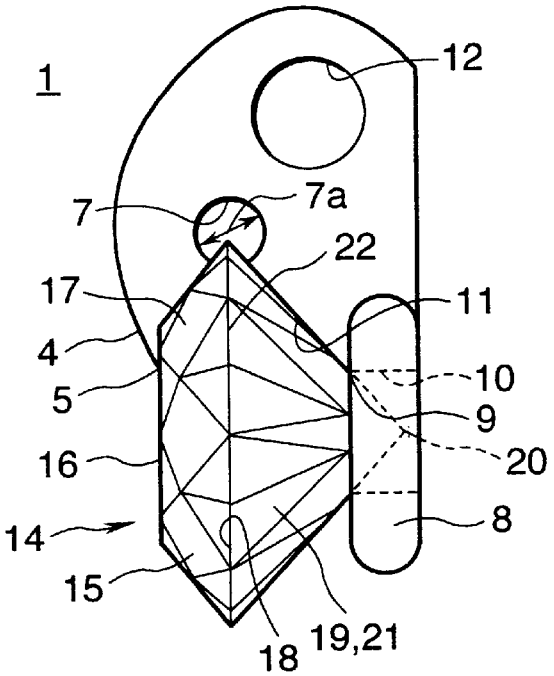
FIG. 1B shows a side surface view of a jewel holding device structure of the present invention.
Figure 2A:
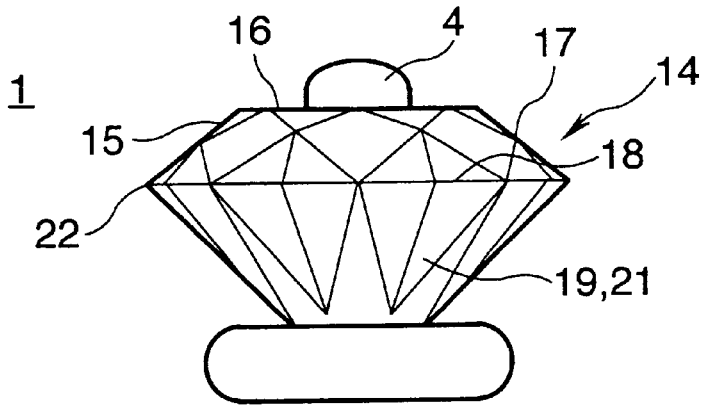
FIG. 2A shows a lower view of the structure shown in FIG. 1.
Figure 2B:
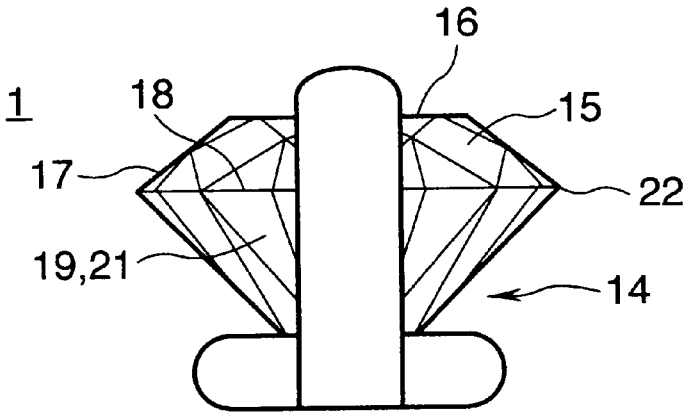
FIG. 2B shows an upper view of the structure shown in FIG. 1.
Figure 2C:
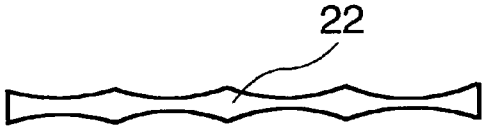
FIG. 2C shows an enlarged view of the girdle between the frusto-conical section and the lower conical section of the jewel shown in FIG. 1.
Figure 3:
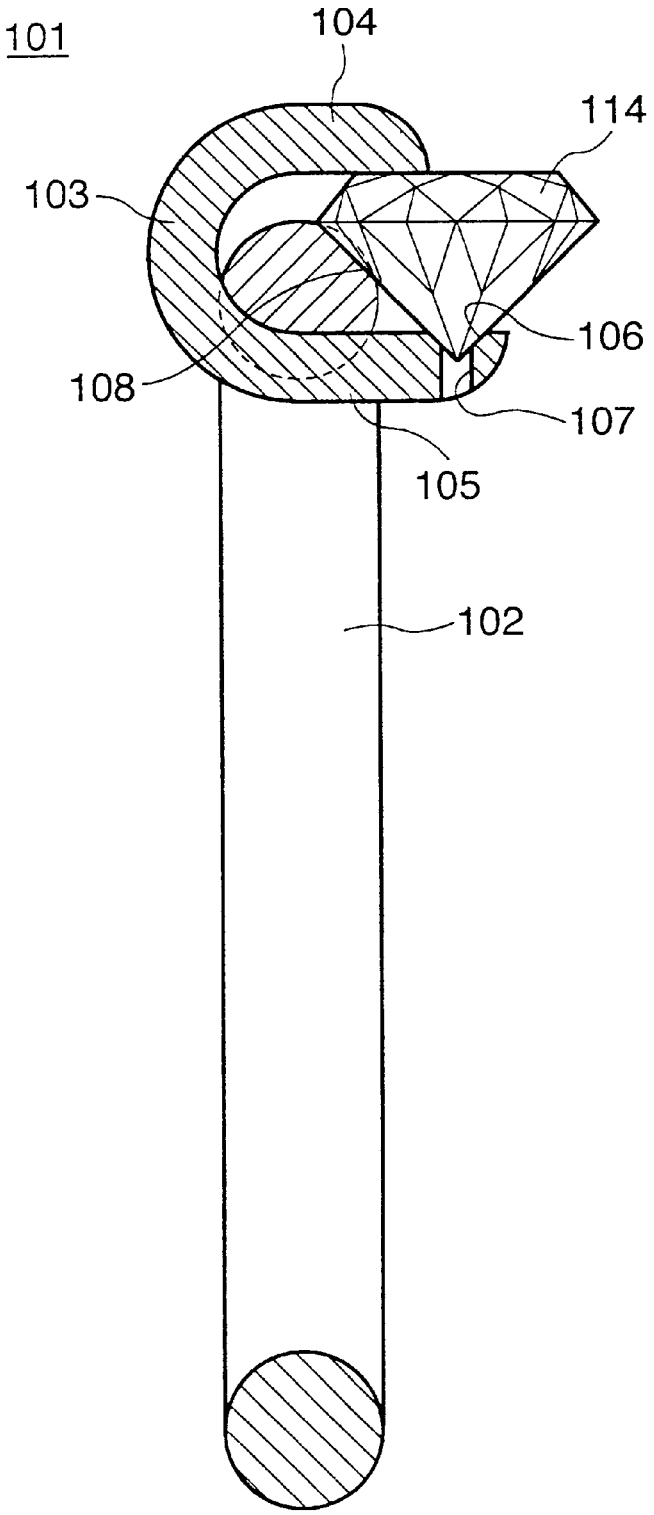
FIG.3 PRIOR ART
FIG. 3 shows a cross-sectional view of a prior art jewel holding device.
Figure 4A:
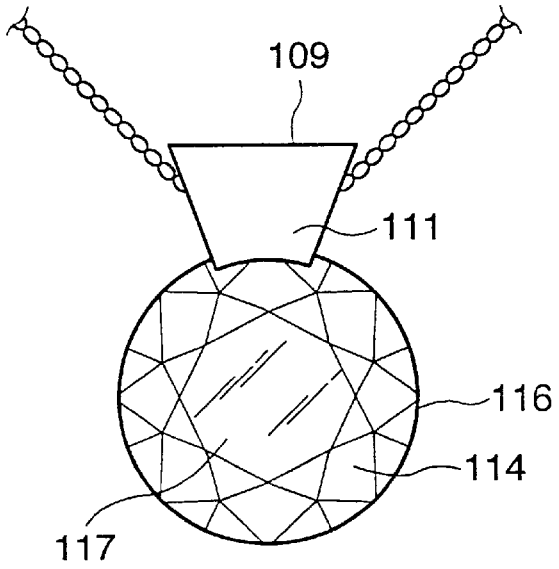
FIG.4A PRIOR ART
FIG. 4A shows a front view of another prior art jewel holding structure.
Figure 4B:
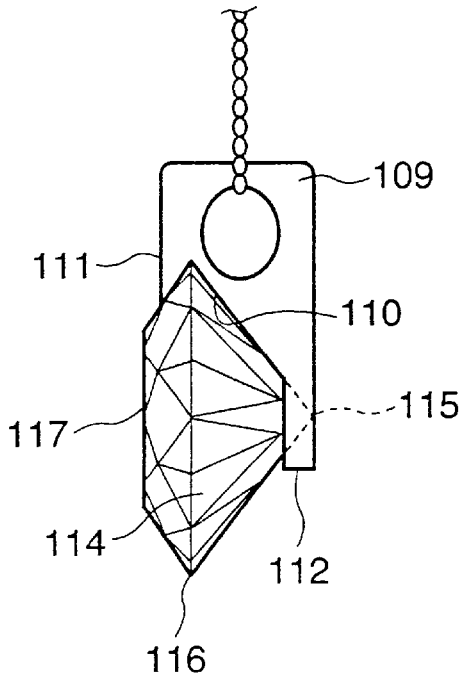
FIG.4B PRIOR ART
FIG. 4B shows a side view of another prior art jewel holding structure.

FIG. 1 shows one embodiment of a jewel holding device of the present invention, wherein FIG. 1A is a frontal view and FIG. 1B is a side view. FIG. 2 shows the jewel holding device of FIG. 1 in different views: FIG. 2A is a bottom view, FIG. 2B a top view, and FIG. 2C an enlarged view of the girdle between the frusto-conical section and the lower conical section of the jewel.

A jewel holding device 1 of the embodiment shown in FIGS. 1 and 2 holds a facet-cut jewel 14. This jewel has a frusto-conical section 15 which includes a crown 17, which is the conical side surface of the upper approximate conical section, and a table 16 which is a flat section formed by cutting the top side of this approximate conical section in parallel with the bottom surface 18 and has a lower conical section 19, approximately conical, at the lower side.

The jewel holding device 1 of the embodiment comprises a claw section 4 of narrow width for engaging with the crown 17 and the table 16, an engaging section 11 for engaging with a pavilion 21, which is the side conical surface of the lower conical section 19, a support seat 9 for supporting the region near a culet 20, which is the head point of the lower conical section 19, wherein the claw section 4, the engaging section 11, and the support seat 9 are integrally formed. Further, the jewel holding device 1 is provided with a contact avoiding section 7 for avoiding contact with a girdle 22 between the crown 17 and the pavilion 21.

The claw section 4 engages with both the crown 17 and the table 16 of the jewel 14. And in this embodiment, from the direction looking through the table 16, the end 5 of the claw section 4 that engages with the table 16 is positioned at the outer side of the support seat 9 at the lower conical section of the jewel 14. Aside from the part of the contact avoiding section 7 of the pavilion 21, the engaging section 11 with a certain width engages with the pavilion 21 all the way to the support seat 9. The support seat 9 supports the region around the culet 20 of the jewel 14, and in this embodiment, forms a circumferential seat with a corner section of a seat hole 10. The support seat 9 need not have this corner section but could have a planar surface structure for receiving the jewel 14. Further, the seat hole 10 as shown in FIG. 1A can be a hole that is bored through, but it can also be U-shaped cross-sectionally such that the hole does not bore through to the other side.

The contact avoiding section 7 is concave shaped with sufficient allowable elastic deformation for holding the jewel 14 by the jewel holding device 1. Its inner structure forms a concave arc that exceeds 180 degrees viewed from the side, and the inner diameter 7*a* has a substantial length. The contact avoiding section 7 in the present embodiment forms an arc but need not necessarily be limited to this shape in that it can be elliptical, rectangular, or triangular as well. However, from the stand point of stress concentration, it would be preferable to have the inner structure of the contact avoiding section 7 formed in a smooth line. The arc or arcuate inner structure of the contact avoiding section 7 does not concentrate stress, and hence, it does not easily break. Also, this structure would be easier to manufacture.

Also, from the direction looking into the table 16, the position of the end 5 of the claw section 4 engaging with the table 16 is at a position outside of the support seat 9 at the lower conical section of the jewel 14. The hole 12 is for passing through a string or a chain at the upper side.

The aforementioned claw section 4, the contact avoiding section 7, the engaging section 11, and the support seat 9 and such are integrally formed in that after subjecting one jewel holding device material to cutting and grinding process, forging process, and forming process, if necessary, the surface processing procedure and heat treatment procedure and such are applied. An appropriate order of these procedures—forming process, surface processing procedure, heat treatment procedure, etc.—is determined by considering these procedures as a whole in combination.

The jewel holding device 1 of the embodiment having the aforementioned structure is actualized in the following manner. According to the jewel holding device 1 of the embodiment comprising the claw section 4 engaged with the crown 17 and the table 16, the engaging section 11 engaged with the pavilion 21 of the lower conical section, and the support seat 9 supporting the region around the culet 20 of this lower conical section, there is no movement or looseness of the jewel since the claw section 4 contacts all the way to the table 16; and the jewel is held tightly without the concern of it becoming detached because of the reinforcement of the claw section 4, the engaging section 11 and the support seat 9.

Further, the jewel holding device 1 has a claw of narrow width such that the jewel is exposed significantly more to improve the aesthetics. Moreover, since the device is integrally formed, it is reliably strong as well as being easy to manufacture, and since the clamping processes for fixing the jewel are reduced, cost reduction is also realized.

FIG. 2C indicates an enlarged view of the structure of the girdle 22 of the jewel 14. Even against the variation on the structure of the jewel 14, especially on the thickness of the girdle, since the contact avoiding section 7 is provided to avoid contacting the girdle, the crown 17 and the pavilion 21 of the jewel 14 are able to engage with and contact the jewel holding device 1 securely and the jewel itself is held very securely.

Further still, since the contact avoiding section 7 is formed in a concave shape size capable of elastic deformation, that is, formed in a relatively large concave arc or arcuate shape for adequately holding the jewel, an elastic deformation can occur between the claw section 4 and the support seat 9 to sandwich the jewel 14 in between, and additionally, the jewel can be held securely even when there are variations in the angle formed by the girdle and the crown.

Viewed from the direction looking through the table 16, the end 5 of the claw section 4 engaged with the table 16 is positioned at the outer side of the support seat 9 at the lower conical section of the jewel 14, so that, with respect to FIG. 1B, the force operating from the claw section 4 to the jewel 14 and the force operating from the engaging section 11 to the jewel 14 balance to stably hold the jewel and, at the same time, the device 1 allows significant exposure of the surfaces of the jewel to maintain or improve the aesthetics.

A detail explanation of the preferred embodiment of the present invention with figures was given above but this should not be construed to limit the scope of the invention. The scope of the invention should be determined by the appended claims and their legal equivalents, rather than by the example given.

What is claimed is:

1. A jewel holding device in combination with and holding a facet cut jewel, said jewel having an upper frusto-conical section with a flat top surface and an upper conical side surface, a lower conical section with a lower conical side surface and an apex, and a girdle located between said upper frusto-conical section and said lower conical section, said device comprising:

a claw section concurrently engaging said flat top surface and upper conical side surface of said jewel;

an engaging section contacting said lower conical side surface;

a support seat supporting a region about said apex;

a contact avoiding section avoiding contact of said device with said girdle; and wherein said claw section, engaging section and support seat are integrally formed together with said contact avoiding section.

2. The jewel holding device of claim 1 wherein an end of said claw section is positioned at an outer side of said support seat when viewed from a direction looking through said flat top surface.

3. The jewel holding device of claim 2 wherein said contact avoiding section has a concave shape capable of being elastically deformed when said jewel holding device is holding said jewel.

* * * * *

UNITED STATES PATENT AND TRADEMARK OFFICE

CERTIFICATE OF CORRECTION

PATENT NO. : 5,974,831

DATED : November 02, 1999

INVENTOR(S) : Afuku et al.

It is certified that error appears in the above-identified patent and that said Letters Patent is hereby corrected as shown below:

ON THE TITLE PAGE:

ITEM [73] Assignee: Delete "Yama Co. Lt." and replace with --Yama Co., Ltd.--.

Signed and Sealed this

Twenty-third Day of May, 2000

*Attest:*

Q. TODD DICKINSON

*Attesting Officer*

*Director of Patents and Trademarks*